United States Patent [19]

Hottinger et al.

[11] 4,069,740

[45] Jan. 24, 1978

[54] AUTOMATIC WEAPON EQUIPPED WITH AT LEAST TWO CARTRIDGE MAGAZINES

[75] Inventors: Conrad Hottinger, Zurich; Albert Wüst, Oberengstringen; Pierre Jenzer, Wallisellen, all of Switzerland

[73] Assignee: Werkzeugmaschinenfabrik Oerlikon-Buhrle AG, Zurich, Switzerland

[21] Appl. No.: 710,225

[22] Filed: July 30, 1976

[30] Foreign Application Priority Data

Aug. 14, 1975 Switzerland ..... 10603/75

[51] Int. Cl.[2] ..... F41D 9/02

[52] U.S. Cl. ..... 89/33 SF; 89/33 BA

[58] Field of Search ..... 89/33 SF, 33 BA

[56] References Cited

U.S. PATENT DOCUMENTS

| | | | |
|---|---|---|---|
| 661,897 | 11/1900 | Toll | 89/33 BA |
| 1,709,399 | 4/1929 | Herlach et al. | 89/33 SF |
| 3,314,182 | 4/1967 | Harvey | 89/33 SF |
| 3,331,281 | 7/1967 | Jafvert | 89/33 SF |
| 3,596,556 | 8/1971 | Montana | 89/33 SF |

*Primary Examiner*—Stephen C. Bentley

*Attorney, Agent, or Firm*—Werner W. Kleeman

[57] ABSTRACT

An automatic weapon equipped with at least two cartridge magazines from which loose cartridges can be conveyed into a common discharge channel, and a device for switching the cartridge infeed from one cartridge magazine to the other. The switching device embodies mechanism which can be selectively adjusted into two positions independent of emptying of one of the cartridge magazines. By means of the mechanism the cartridges in each instance can be fed, in one position of the mechanism, from the one cartridge magazine into the discharge channel and at the same time are blocked in the other cartridge magazine.

6 Claims, 8 Drawing Figures

AUTOMATIC WEAPON EQUIPPED WITH AT LEAST TWO CARTRIDGE MAGAZINES

BACKGROUND OF THE INVENTION

The present invention relates to a new and improved construction of an automatic firing weapon having at least two cartridge magazines from which there can be conveyed loose cartridges into a common discharge or outfeed channel, and a device for switching the cartridge infeed from one cartridge magazine to the other.

With a weapon as is known from U.S. Pat. No. 3,043,198 a number of cartridge magazines or compartments are arranged in parallelism next to one another and in which there are stacked loose cartridges. Initially the cartridges are conveyed out of the compartment which is furthest from the center of the weapon. After emptying this compartment there is automatically opened the neighboring compartment situated closer to the center of the weapon. A drawback of this weapon is that it is not possible at any time to select the emptying of a given compartment, as such is required if there should be fired different types of ammunition in accordance with the relevant battle conditions.

Further, there is known a firing weapon from German Patent publication No. 471,398 in which two cartridge magazines or compartments can be inserted into two magazine chambers. In order to switch the infeed or delivery of cartridges from the first cartridge magazine to the second magazine, it is necessary that either the first cartridge magazine is empty or that it is ejected without being emptied, i.e. that the relevant magazine chamber is empty. If it is desired to then change-over from the second magazine to the first, then first of all the first cartridge magazine must be again inserted and the second either must be empty or ejected. A rapid change-over of the cartridge infeed from one magazine to the other and back again is therefore not possible.

SUMMARY OF THE INVENTION

Hence, it is a primary object of the present invention to provide an improved construction of automatic firing weapon equipped with at least two cartridge magazines which is not associated with the aforementioned drawbacks and limitations of the prior art proposals.

Another object of the present invention aims at overcoming the aforementioned drawbacks and providing a weapon having at least two cartridge magazines wherein it is possible to select, at any time, the removal of cartridges from a predetermined magazine.

Now in order to implement these and still further objects of the invention, which will become more readily apparent as the description proceeds, the invention contemplates that the switching device comprises mechanism which can be selectively adjusted into two positions and independent of emptying one of the cartridge magazines. By means of such adjustment mechanism the cartridges can be delivered, in one position of such mechanism, from one cartridge magazine into the delivery channel and at the same time are blocked in the other cartridge magazine.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
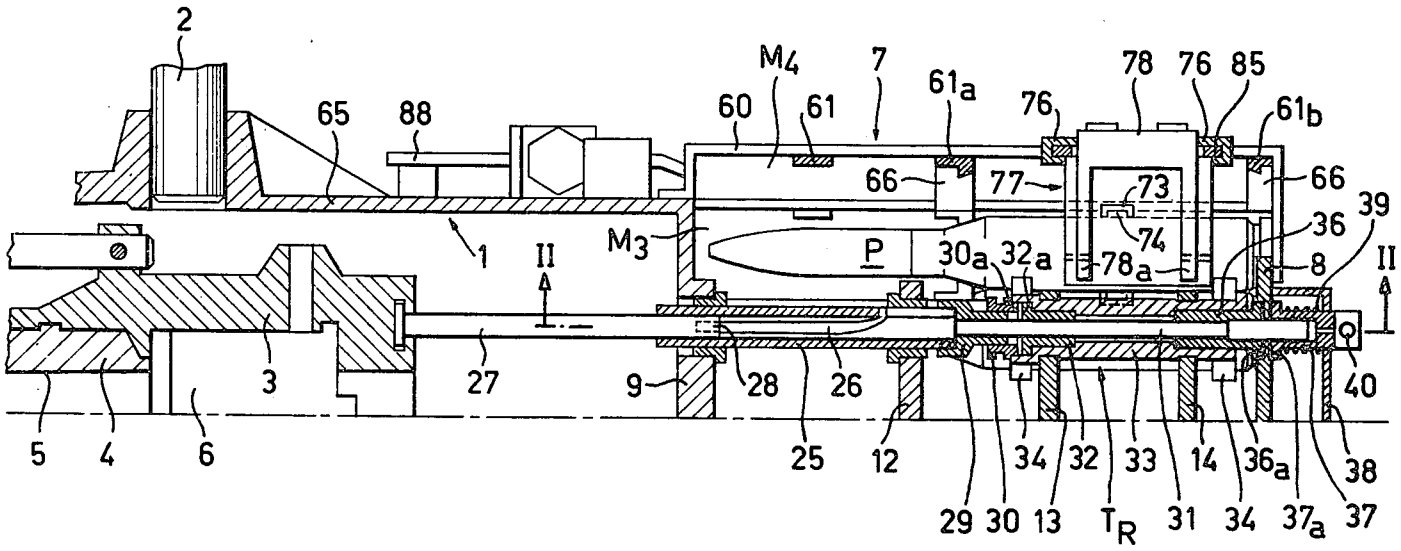
FIG. 1 is a horizontal sectional view through the right side of an automatic firing weapon equipped with cartridge magazines i.e. a section along the line I — I of FIG. 5 or FIG. 6.

Describing now the drawings, according to the showing of FIG. 1 a housing 1 of the automatic firing weapon or gun is mounted to be elevationally displaceable upon two trunnions 2 in a turret, for instance an armored battle vehicle. A base or floor portion 3 is arranged to be rearwardly movable in any suitable and therefore not particularly illustrated manner in the housing 1. A barrel 4 possessing a cartridge chamber 5 is inserted into the base portion 3. A wedge-type breechblock 6 is vertically displaceable in the base portion 3.

The housing 1 possesses a rear housing portion 7 which essentially consists of a rectangular frame mounted upon a housing wall 8 extending perpendicular to the not particularly referenced lengthwise axis of the weapon and a first intermediate wall 9 parallel to the housing wall 8. The frame possesses second, third and fourth intermediate walls 12, 13 and 14 respectively. The third and fourth intermediate walls 13 and 14 are interconnected by a base or floor 15 directed perpendicular thereto. The second intermediate wall 12, according to the showing of FIGS. 2 and 3, has a rearwardly directed web 16 in which there are formed two slots 17 having guide grooves 18. Two thrust elements 19, each possessing a downwardly directed switching finger 20, engage into the guide grooves 18 and are thus displaceable in the slots 17. At the second intermediate wall 12 there are arranged two hydraulic cylinders 21 having the piston rods 22. At the third intermediate wall 13 there are attached two switches 23. The planes of symmetry of the slots 17 are located parallel to one another and at the same spacing to opposite sides of the lengthwise central plane of the weapon. In each of these two planes there is further located the lengthwise axis of the associated piston rod 22 and the lengthwise axis of an oppositely directed actuation component 24 of the neighboring switch 23. Further, there is located in each of the aforementioned planes the lengthwise axis of a cartridge transport device $T_R$ and $T_L$ respectively (the position of the components of the ammunition infeed of the weapon relative to the lengthwise central plane will be hereinafter indicated by the reference characters R (meaning right) and L (meaning left) associated with the corresponding reference numeral; in FIGS. 1 and 2 there is only shown the right transport device $T_R$).

Figure 2:
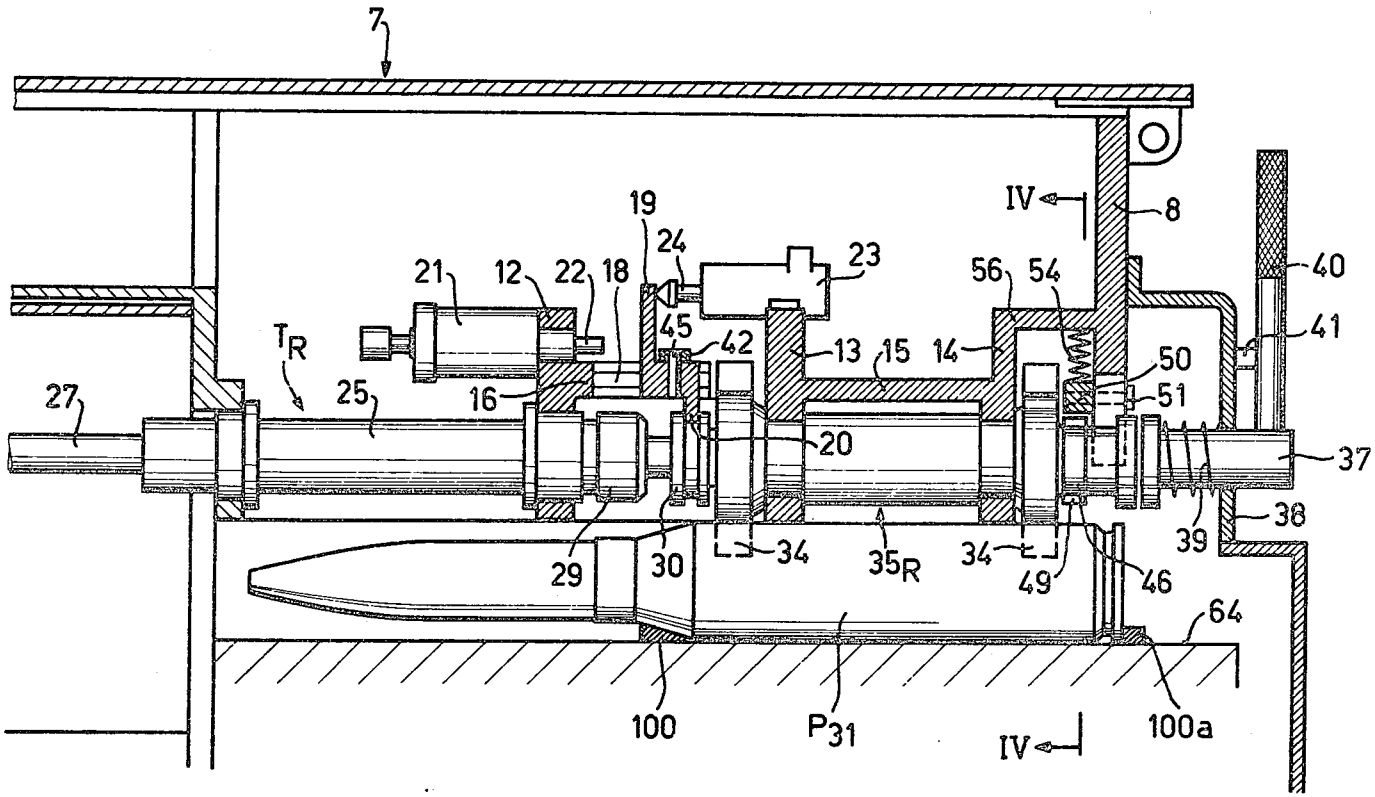
FIG. 2 is a vertical sectional view taken along the line II — II of FIG. 1.

According to the showing of FIGS. 1 and 2 the cartridge transport device $T_R$ possesses a sleeve 25 rotatably mounted in the first and second housing walls 9 and 12. In the sleeve 25 there is cut a helical- or screw-shaped slot 26. The directions of rotation of slot 26 are opposite to one another for the two transport devices $T_R$ and $T_L$. A rod 27 secured in the base portion 3 extends into the sleeve 25. A cam or dog 28 connected with the rod 27 is guided in the slot 26. A connection element 29 is keyed to the sleeve 25 and is connected in driving relationship via a not particularly illustrated freewheeling coupling with a coupling collar 30 which is displaceable thereon. According to the showing of FIG. 2 the switching finger 20 of the corresponding thurst element 19 engages with the coupling collar 30. A shaft 31 is keyed with a bushing 32 which, in turn, is keyed with the hub 33 of a cartridge switching or indexing wheel $35_R$ possessing two four-tooth star wheels 34. The hub 33 is mounted at the third and fourth intermediate walls 13 and 14 of the housing and keyed with a sleeve 36 fixedly seated upon the shaft 31. A further sleeve 37 is displaceably mounted upon the end of the shaft 31 and extends rearwardly out of the housing.

On the one hand, two confronting end surfaces 30*a* and 32*a* of the bushing 32 and the coupling collar 30 and, on the other hand, two end surfaces 36*a* and 37*a* of both sleeves 36 and 37 are provided with teeth which can come into coupling engagement with one another. The sleeve 37 is subjected to the pressure of a spring 39 bearing against the housing wall 38. A handle 40 or the like connected with the sleeve 37 bears under the pressure of spring 39 against a stop 41 which retains the teeth of the sleeves 36 and 37 out of engagement with one another.

Figure 3:
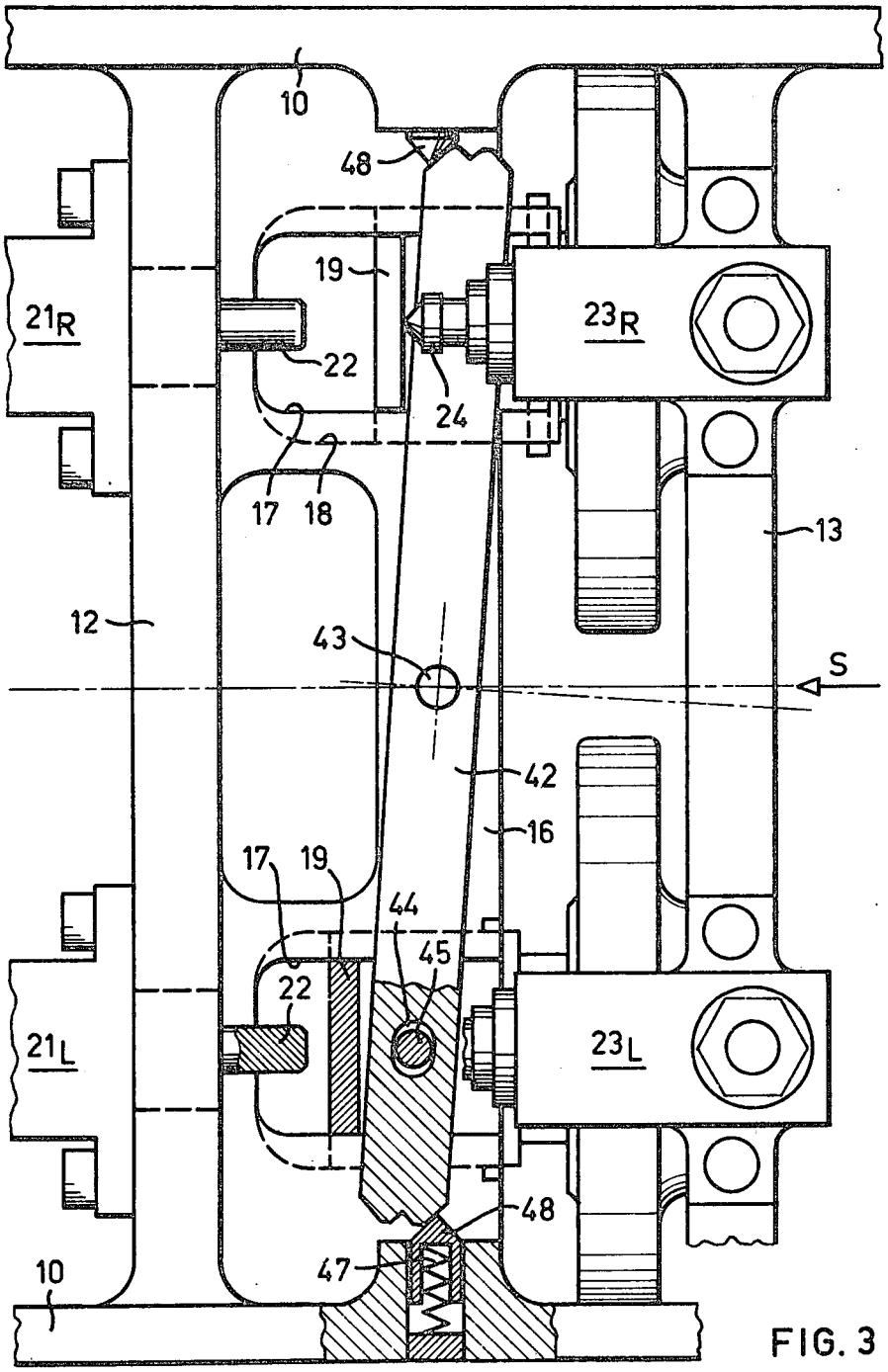
FIG. 3 is a plan view of part of the firing weapon illustrated in FIG. 2.

According to the showing of FIG. 3 a lever 42 is pivotable about a shaft 43 which is connected with the web 16. Lever 42 possesses two elongate holes 44 into each of which there engages a respective bolt 45 connected with its associated thrust element 19. The ends of the lever 42 are beveled or inclined at both sides. In the housing wall 10 there are displaceably mounted the securing bolts 48 exposed to the pressure of the springs 47.

Figure 4:
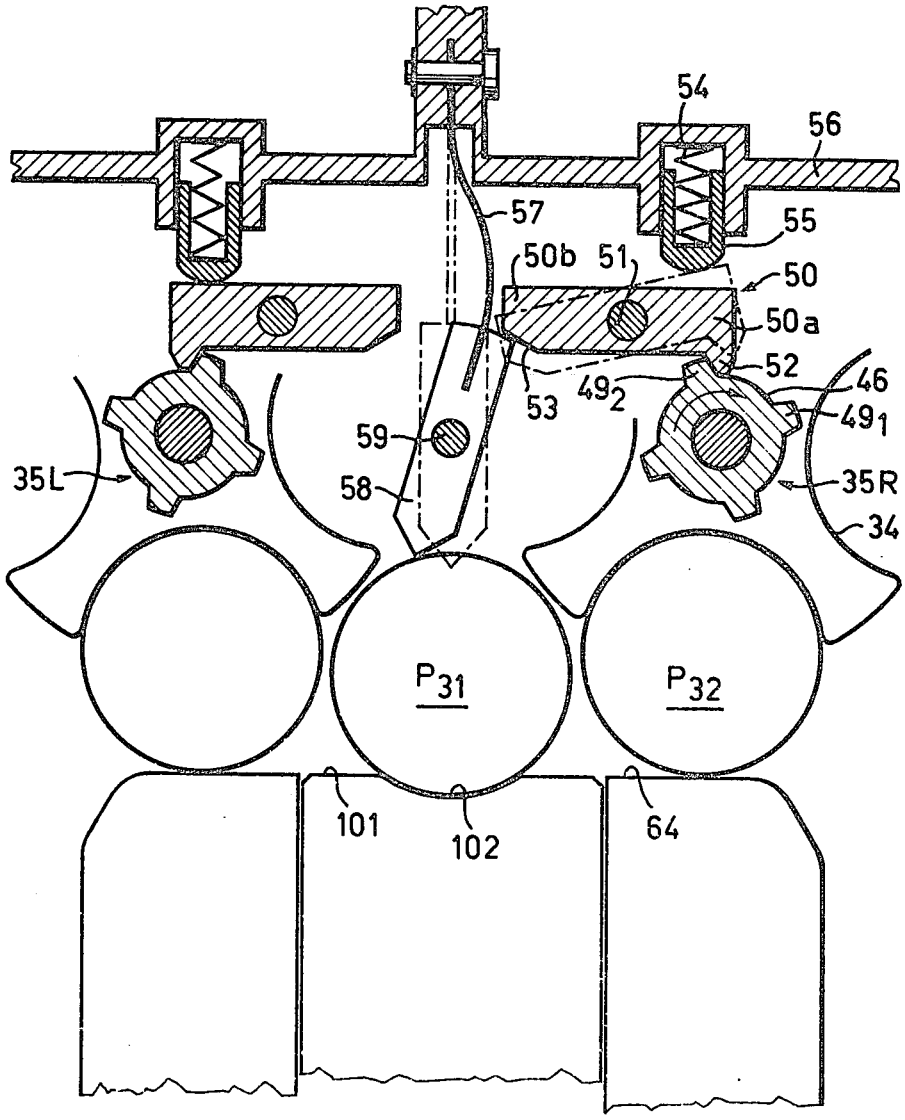
FIG. 4 is a cross-sectional view taken along the line IV — IV of FIG. 2.

The rear ends 46 of the hubs 33 of the switching wheels $35_R$ and $35_L$, according to the showing of FIG. 4, are provided with a number of wedges 49 (if desired four) corresponding to the number of teeth or recesses of the star wheel 34. Two double-arm pawls 50 are pivotably mounted upon the shafts 51 secured in the housing rear wall 8. The arm 50*a* of each of the pawls 50 which is directed towards the associated switching wheel $35_R$ and $35_L$ possesses a tooth 52. At the other pawl arm 50*b* there is milled or otherwise suitable formed a surface 53. A spring 54 bears at a cover 56 and acts, through a bushing 55 displaceably guided therein, upon the associated pawl arm 50*a*. A leaf spring 57 is secured at the center of the weapon at the cover or cover member 56. The other end of the leaf spring 57 is attached at a positioning or transfer body 58 which is mounted upon a shaft 59 inserted into the housing rear wall 8.

Figure 5:
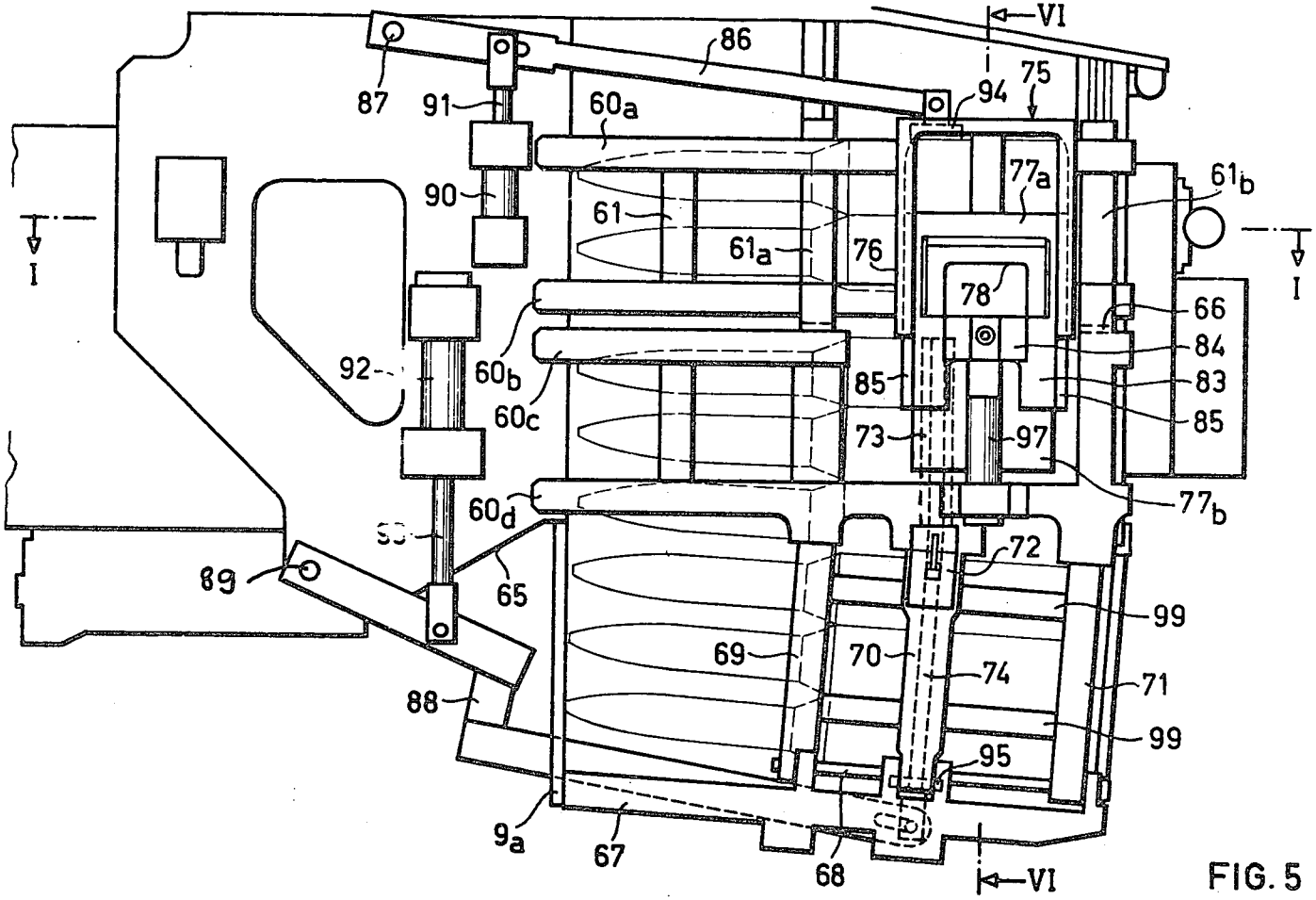
FIG. 5 is a side view of the cartridge magazine of the firing weapon.
Figure 6:
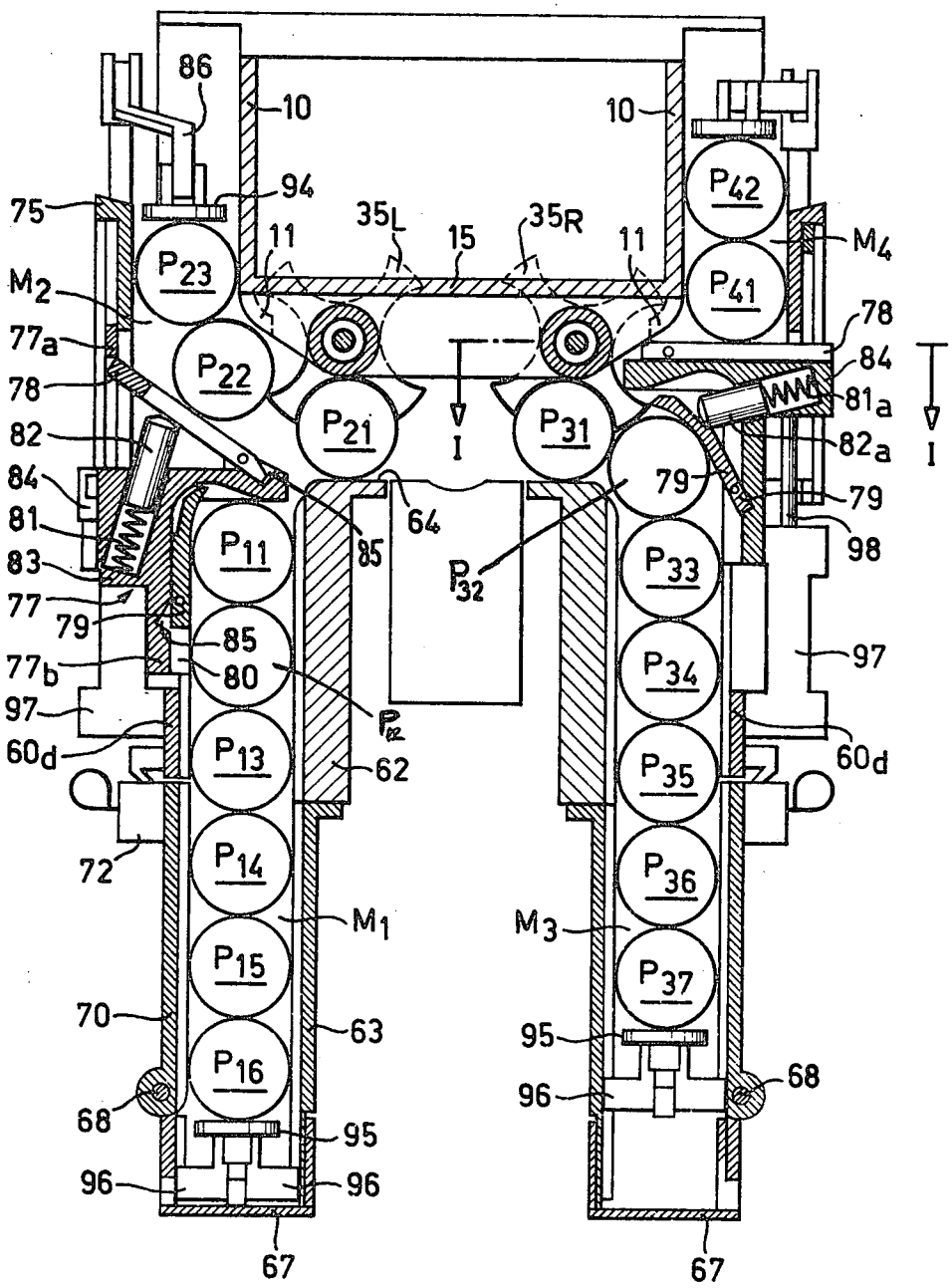
FIG. 6 is a cross-sectional view taken along the line VI — VI of FIG. 5, showing a first position of a cartridge infeed device.

According to FIGS. 1, 5 and 6 there are arranged at both sides of the rear housing portion 7 four cartridge magazines $M_1$ to $M_4$. The cartridges P arranged in the magazines $M_1$ to $M_4$ are guided by the switching or indexing wheels $35_R$ or $35_L$ to an infeed plate 101 (see FIG. 4) provided with a recess 102 and are designated by double place index numerals, wherein the first numeral indicates the association with a magazine and the second numeral the sequence or position of the cartridge from the infeed plate 101. Each magazine M is bounded at the outside by struts 60, 61 arranged at right angles to one another and formed, for instance, by flat iron members. The inner boundary of the upper magazines $M_2$ and $M_4$ is formed by walls 10 of the rear housing portion 7, the lower edges of which are bent inwardly at an inclination in the form of cartridge guides 11, as shown in FIG. 6. At both sides of the weapon axis there are secured to the housing rear wall 8 plates 62 and rails 63 which are connected with such plates 62 so as to form the inner boundary of the lower magazines $M_1$ and $M_3$. The end surfaces 64 of the plates 62 form guide surfaces for the cartridges and are provided with transversely situated guide ledges 100, 100*a* (see FIG. 2). The ends of the struts $60_a$ to $60_d$ are attached to a side wall 65 and the rear wall 8 of the housing 1. The struts $60_a$ to $60_d$ are interconnected by vertical rails $61_a$, $61_b$ arranged at their inner side. Each rail $61_a$ is constructed to guide the cartridges at the conical portion of their sleeves and the rails $61_b$ to guide the base of the cartridges. Not particularly illustrated guides, corresponding in construction to the rails 61, are also secured at the housing walls 10.

According to the showing of FIG. 1 the rails $61_a$ and $61_b$ are beveled towards the inside and form a shoulder or projection 66. A base element or portion 67 (see FIGS. 5 and 6) of substantially U-shape is attached at an extension $9_a$ of the first intermediate wall 9 and at the rails 63 connected with the plates 62. A shaft 68 is rotatably mounted at the base element 67. Three rails 69, 70, 71 are keyed with the shaft 68 and mutually interconnected by side struts 99. The intermediate rail 70 is provided with a snap catch or lock 72 and can be locked with the strut $60_d$. The rail 70, the rail 63 opposite thereto, which rail 70 continues upwardly in a rail 73 connected with the strut $60_d$ and the plate 62 possess a groove 74 as shown in FIG. 1.

A downwardly open frame 75 having legs 76 is inserted into the struts $60_a$, $60_b$. The symmetry plane of the frame 75 is parallel to the housing rear wall 8. The legs 76 of the frame 75, according to the showing of FIG. 1, possess U-shaped guide grooves $76_a$ facing one another. A slide 77 is displaceable in the frame 75 in that two laterally arranged ledges 85 engage in the guide grooves $76_a$ of the frame legs 76. The slide 77 has an upper portion $77_a$ constructed as a frame and a lower portion $77_b$. Side legs $78_a$ of a frame-shaped guide portion 78 which is open at one side are articulated at the lower slide portion $77_b$. A further guide portion 79 (see FIG. 6) is articulated at two ledges 80 which protrude inwardly from the lower slide portion $77_b$. The guide portions or guides 78 and 79 are subjected to the pressure of two respective bushings 82 loaded by springs 81, and which bushings are displaceably arranged in blind-hole bores of the projections 83 and 84 of the slide portion $77_b$. At the left-half of the showing of FIG. 6 there is illustrated a spring 81 and bushing 82 associated with the guide portion 78, whereas the right-half of FIG. 6 illustrates the other spring $81_a$ and bushing $82_a$ associated with the guide portion 79.

FIG. 5 shows that to both sides of the housing 1 two respective levers 86, 88 are pivotable about shafts 87, 89 connected with the housing wall 65. Piston rods 91 and 93 of two hydraulic cylinders 90 and 92, respectively attached to the housing wall 65 are hingedly connected with the levers 86 and 88 respectively. At the ends of the levers 86 and 88 there are hingedly secured (see FIG. 6) the plates 94 and 95 respectively associated with the magazines $M_1$, $M_2$ and $M_3$, $M_4$ respectively. The plate 95 connected with lever 88 possesses cams or dogs 96 which engage with the grooves 74 of the guides 70, 73 and 62, 63. A further hydraulic cylinder 97 (FIGS. 5, 6) is attached to the strut 60*d* and its piston rod 98 extends between both of the projections 83 of the slide 77 and is connected therewith.

Figure 8:
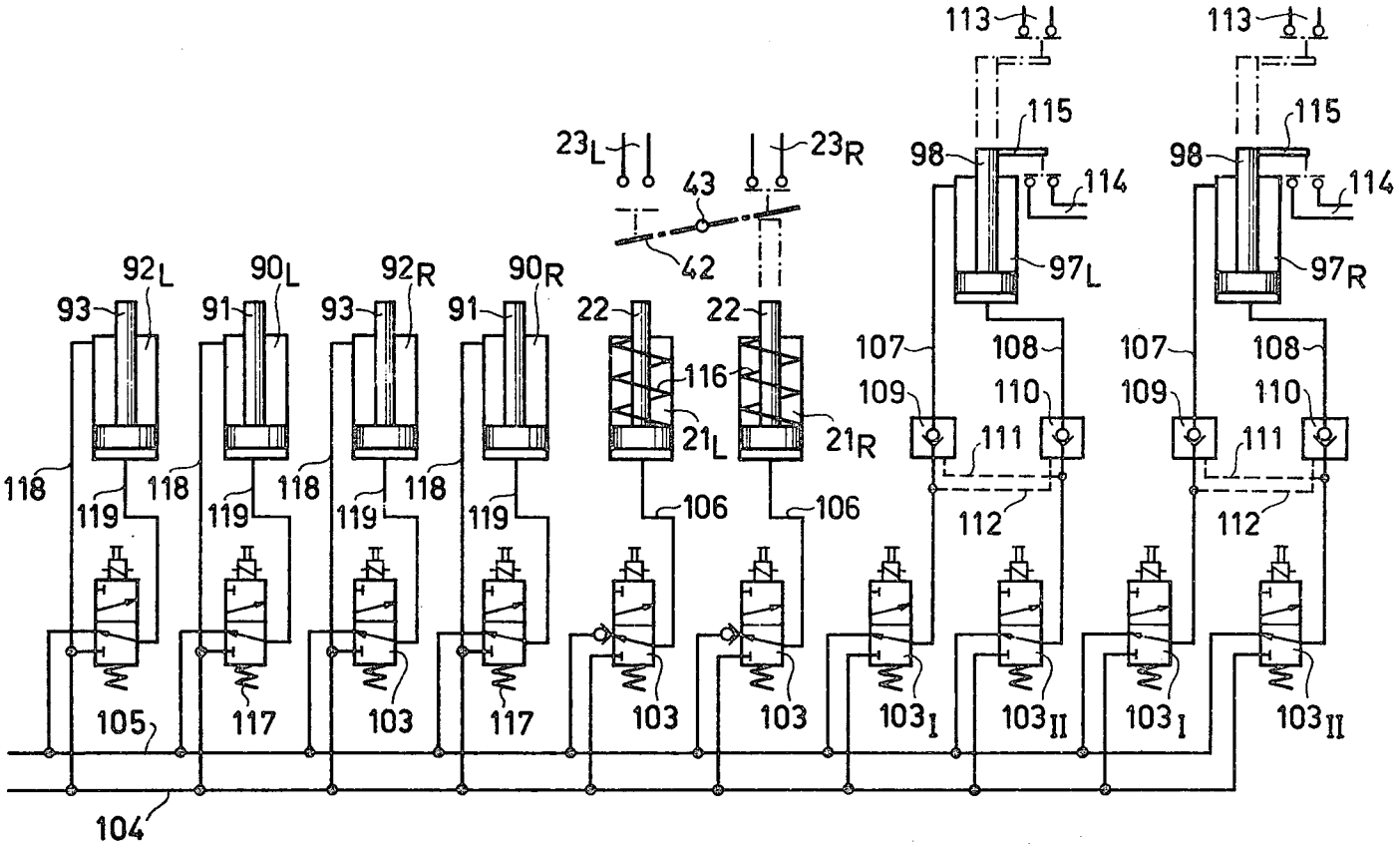
FIG. 8 is a schematic view of the hydraulic part or circuit of the cartridge infeed device.

According to the showing of FIG. 8 the hydraulic cylinders $\mathbf{21}_R$ and $\mathbf{21}_L$ arranged to the right and left of the lengthwise central plane of the weapon each have operatively associated therewith a two-way valve 103. A respective connection or stud of valves 103 is coupled with a supply line 104 connected with a not particularly illustrated pump. A further connection of the valves 103 is coupled with a return flow line or conduit 105 leading to a likewise not particularly illustrated oil reservoir. Each of the cylinders $\mathbf{21}_R$ and $\mathbf{21}_L$ is connected by a conduit or line 106 with a respective further connection of the associated valve 103. The pistons 22 of these cylinders $\mathbf{21}_R$ and $\mathbf{21}_L$ are loaded by springs 116. Terminal switches $\mathbf{23}_L$, $\mathbf{23}_R$ are arranged to the left and right and are actuatable via the lever 42 by means of the piston rods 22 of the cylinders $\mathbf{21}_L$, $\mathbf{21}_R$.

Two valves $\mathbf{103}_I$ and $\mathbf{103}_{II}$ are operatively associated with each hydraulic cylinder $\mathbf{97}_R$ and $\mathbf{97}_L$ arranged to the left and right of the lengthwise central plane of the weapon. A respective connection of each one of the valves $\mathbf{103}_I$, $\mathbf{103}_{II}$ belonging to the corresponding cylinder $\mathbf{97}_R$ and $\mathbf{97}_L$ is connected with the supply line 104 and with the return flow 105. A third connection of each of both valves $\mathbf{103}_I$ is connected by a conduit or line 107 with the one side of the corresponding cylinder $\mathbf{97}_R$ and $\mathbf{97}_L$, and a third connection of each of both valves $\mathbf{103}_{II}$ is connected by a conduit or line 108 with the other side of the corresponding cylinders $\mathbf{97}_R$ and $\mathbf{97}_L$. Mounted in both of the conduits or lines 107 and 108 are check valves 109 and 110 which can be opened. The check valve 109 is connected by means of a conduit 111 with conduit 108, and the check valve 110 is connected by means of the conduit 112 with the conduit 107. Two terminal switches, which can be actuated by a push button or key 115 connected with the associated piston rod 98 of the corresponding cylinder $\mathbf{97}_R$ and $\mathbf{97}_L$ are designated by reference character 114.

Actuation of the cylinders $\mathbf{90}_L$, $\mathbf{90}_R$, $\mathbf{92}_L$, $\mathbf{92}_R$, which are accordingly arranged to the left and right, is likewise controlled by a respective valve 103. A respective connection of each of the valves 103 is coupled with the supply line 104 and the return flow line 105. A third connection is connected via the conduit 119 with that side of the corresponding cylinder $\mathbf{90}_L$, $\mathbf{90}_R$, $\mathbf{92}_L$, $\mathbf{92}_R$ which faces the complete end surface of the associated piston 91, 93. The other side of each cylinder $\mathbf{90}_L$, $\mathbf{90}_R$, $\mathbf{92}_L$, $\mathbf{92}_R$, at which there is impinged the surface of the piston which is reduced by the cross section of the piston rods 91, 93, is likewise connected by means of a conduit 118 with the supply line 104.

Having now had the benefit of the foregoing description of the apparatus of the invention, its mode of operation will be considered and is as follows:

According to the showing of FIG. 6 the slide or slide member 77 shown at the left is located in its lower position where its portion $\mathbf{77}_b$ closes the magazine $M_1$. The guide portion 78 at the left, under the action of the spring 81, is held pivotedout in that position where its end bears at the base of the groove 85 forming a stop. In this position the guide portion 78 is parallel to the inclined guide 11 of the housing and is at a spacing from such which essentially corresponds to the diameter of a cartridge P. It will be seen the cartridge $P_{22}$ bears at the toothed rim of the switching or indexing wheel $\mathbf{35}_L$ and at the guide portion 78. A cartridge $P_{21}$ is held in a preparatory position between two teeth, in a recess of the switching wheel $\mathbf{35}_L$, at the guide surface 64. Six cartridges $P_{11}$ to $P_{16}$ are stacked above one another in the magazine $M_1$. The uppermost cartridge $P_{11}$ bears at the slide portion $\mathbf{77}_b$ and retains the guide portion 79 in its pivoted-in position against the pressure of the spring $\mathbf{81}_a$.

The slide 77 at the right is located in its upper position where passage of cartridges $P_{41}$, $P_{42}$ etc. from the magazine $M_4$ to the switching wheel $\mathbf{35}_R$ is blocked and the guide portion 78 bears against slide portion $\mathbf{77}_b$. A cartridge $P_{31}$ dispensed from the magazine $M_3$ is retained in preparatory position by the switching wheel $\mathbf{35}_R$ at the guide surface 64. Under the action of a force exerted by the cylinder $\mathbf{92}_R$ via the lever 88 and the plate 95 upon the cartridges $P_{33}$ to $P_{37}$ located in the magazine $M_3$, the cartridge $P_{32}$ bears against the teeth of the switching or indexing wheel $\mathbf{35}_R$ and at the guide portion 79 which has been rocked-out under the force of the spring $\mathbf{81}_a$.

The cams or dogs 96 of the plate 95 are spaced from the base portion 67 at a distance which is somewhat greater than the diameter of a cartridge P. This free space is then used as a cartridge reserve space when there is rapidly switched to the infeed of ammunition from the magazine $M_4$. In this case the righthand located slide 77 is lowered until it and the six cartridges $P_{32}$ to $P_{37}$ are located in the same position as the cartridges $P_{11}$ to $P_{16}$ in the magazine $M_1$ and the left-hand slide 77 of FIG. 6. The cartridges $P_{41}$, $P_{42}$ etc. are stacked in the magazine $M_4$ and beat upon the guide portion 78.

With the valve positions as shown in FIG. 8, the cylinders $\mathbf{90}_L$, $\mathbf{90}_R$, $\mathbf{92}_L$, $\mathbf{92}_R$ are connected with the return flow line or conduit 105 and the pistons together with the piston rods 91, 93 exert, via the levers 86, 88 with the plates 94, 95, a switching or indexing force upon the cartridges located in the magazine $M_1$ to $M_4$.

When the lever 42 is located in the position of FIG. 3 then the switching or indexing wheel $\mathbf{35}_R$ is coupled, i.e. the end teeth of the coupling collar $\mathbf{30}_R$ and the sleeve $\mathbf{32}_R$ are engaged with one another. The switching wheel $\mathbf{35}_L$ is uncoupled. To establish the ready for firing condition the barrel 4 together with the base portion 3 are moved rearwardly at increased speed by a conventional piston which thus has not been shown in the drawing. Due to the movement of the cam 28 connected with the rod 27 in the slot 26 of the sleeve 25 the latter, and thus also the connection element 29, the coupling collar 30 and the switching or indexing wheel $\mathbf{35}_R$ are rotated in clockwise direction (viewed in the showing of FIG. 6) through an angle of 90°. Consequently, the cartridge $P_{31}$ is moved out of the preparatory or waiting position along the guide ledges 100, 100*a*, appearing in FIG. 2, to the center of the weapon onto infeed guide member 101 (FIG. 4).

At the beginning of the rotation of the switching wheel $\mathbf{35}_R$ the lever 50, appearing at the right of FIGS. 2 and 4, is rocked in counterclockwise direction (viewed in FIG. 4) under the action of the tooth or wedge $\mathbf{49}_1$ engaging at its tooth 52. When the wedge $\mathbf{49}_1$ has moved through past the tooth 52, then the lever 50, under the action of the spring 54, is again rocked back into the shaded position of the drawing where the tooth 52 bears at the cylindrical portion of the hub end 46. During the further movement the base of the cartridge $P_{31}$ comes into contact with the positioning or transfer body 58 located in the rest position illustrated in broken lines in FIG. 1 and rocks such, while overcoming the bending force of the spring 57, about the shaft 59. At the end of the rotation of the switching wheel $35_R$ the tooth 52 bears against the flank of the tooth or wedge $49_2$ and engages therebehind. Further rotation of the switching wheel $35_R$ is prevented in that the cartridge $P_{31}$ at the end of its movement in the recess 102 of the infeed guide member 101, which takes place without a drive by the switching wheel $35_R$, rotates the positioning body 58 to such an extent that such engages beneath the surface 53 of the lever 50 and locks the same.

Figure 7:
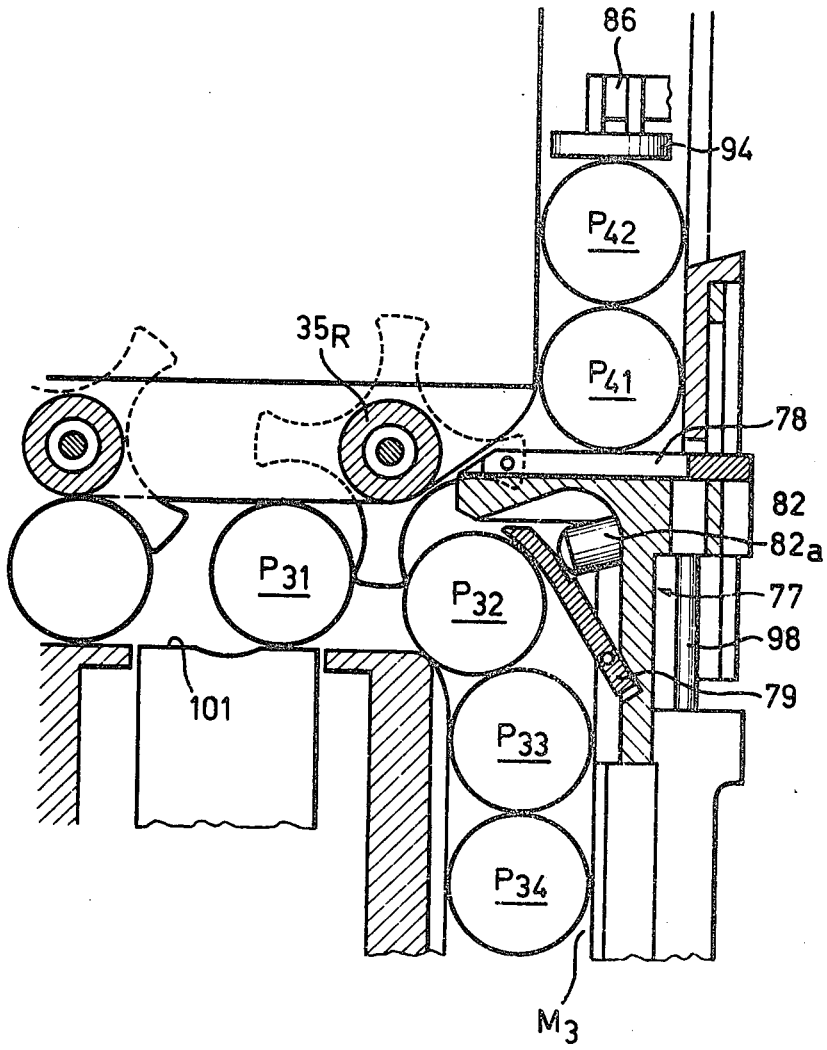
FIG. 7 is a partial sectional view, corresponding to FIG. 6, showing a second position of the cartridge infeed device.

During the rotation of the switching wheel $35_R$ the cartridges $P_{32}$ to $P_{37}$ which are stacked in the magazine $M_3$ are raised under the action of the indexing or feed force transmitted by the plate 95, whereby the cartridge $P_{32}$ is deflected by the guide portion 79 to the switching wheel $35_R$ (FIG. 7). Due to guiding of the plate 95 in the grooves 74 (see FIG. 5) there is achieved the result that such, during its upward directed cartridge feed or conveying movement in the magazine $M_3$, engages at that location of the cartridges where there is located the center of gravity. When the cartridge $P_{31}$, as shown in FIG. 4, has reached the central position, then the base element 3 together with the barrel 4 (FIG. 1), under the action of a recoil spring which is tensioned or biased during its return movement and has not been shown in the drawing, begin to again move forwardly back into the starting position. During this movement the sleeve 25 is again rotated back through an angle of 90° by the cam 28 of the rod 27, wherein, however, this rotational movement is not transmitted to the switching or indexing wheel $35_R$. During the forward movement of the base element 3 together with the barrel 4 the cartridge $P_{31}$ is propelled in further not particularly illustrated manner forwardly into the cartridge chamber 5 of the barrel 4. When the base of the cartridge $P_{31}$ has moved away from the positioning or transfer body 58, such rocks, under the action of the leaf spring 57, back into the rest position. Consequently, the blocking of the lever 50 is released, so that now under the action of the spring 54 such secures the switching wheel 35 against rotation.

After firing of the cartridge $P_{31}$ the base or floor element 3 together with the barrel 4 again moves back under the action of the forces of the gas which are transmitted via the base of the cartridge sleeve to the base element 3. After opening of the breechblock the empty cartridge sleeves are ejected and the switching wheel $35_R$ is again rotated in clockwise direction through 90° in the manner already described (see FIG. 6), and thus, the further cartridge $P_{32}$ is conveyed to the center of the weapon on the infeed guide member 101.

If ammunition should be fired from a magazine $M_1$, $M_2$ located at the left, then the switching wheel $35_R$ must be uncoupled from its drive and the switching wheel $35_L$ must be coupled with its drive mechanism. If, for this purpose, the valve 103 of the cylinder $21_L$ is displaced out of the position illustrated in FIG. 8, so that the spring 117 is tensioned, then the cylinder $21_L$ is connected with the supply line 104. The piston with the piston rod $22_L$ displaces the left thrust element 19, and therefore also the left coupling collar 30 rearwardly opposite to the firing direction S (viewed in FIG. 3) and rocks the lever 42 in the counterclockwise direction about the shaft 43, whereafter such is fixed in its new position by the bolt 48. The rocking lever 42 displaces the right thrust element 19 together with the right coupling collar 30 towards the front, so that its teeth and those of the sleeve 32 of the switching wheel $35_R$ are brought out of engagement. At the same time there is established the driving connection of the coupling collar $30_L$ with the switching wheel $35_L$. During the movement of the left thrust element 19 there is activated the terminal switch $23_L$, so that the valve 103 associated with the cylinder $21_L$, under the pressure of the spring 117, again assumes the position illustrated in FIG. 8. Since the cylinder $21_L$ is now connected with the return flow line 105, the spring 116 can again move the piston together with the piston rod 22 back into the rest position.

The cartridges from the magazine $M_1$ and $M_2$ are conveyed by the switching wheel $35_L$, driven in the counterclockwise direction, towards the center of the weapon onto the infeed guide member 101.

When the switching wheel $35_L$ should have delivered thereto cartridges $P_1$ from the magazine $M_1$, then, the left slide 77 must be moved upwardly out of the position of FIG. 6. For this purpose the valve $103_{II}$ associated with the cylinder $97_L$ is displaced out of the position according to FIG. 8, against the pressure of the spring 117, so that then the conduit or line 108 is connected with the supply line 104 and the piston engaging at the slide 77 with the piston rod 98 are moved upwardly. Since pressure now also appears in the line or conduit 111, the check valve 109 is opened, and the oil displaced out of the cylinder $98_L$ can flow through the line or conduit 107 and through the valve $103_I$ to the return flow line 105. At the end of the stroke of the piston rod 98 the key or actuator element 115 actuates the terminal switch 113, and the valve $103_{II}$ can be moved by the pressure of the spring 117 back again into its original position. The line or conduit 108 is now again in flow communication with the return flow line 105, so that pressure no longer prevails in the conduit 111 and the check valve 109 prevents the return flow of oil out of the cylinder $97_L$. Since now also the check valve 110 blocks the return flow out of the cylinder $97_L$. the piston together with the piston rod 97, and therefore also the left slide 77, remain hydraulically locked in the upper position shown in broken lines in FIG. 8.

The operation of loading the magazines $M_1$ to $M_4$ will be explained hereinafter by way of example with respect to the magazine $M_3$. The valve 103 located in the position of FIG. 8 and associated with the cylinder $92_R$ is shifted. After such adjustment the spring 117 is tensioned and both faces of the piston are connected with the supply line 104. Consequently, the piston with the piston rod 93 move in a direction opposite to the cartridge indexing or feed direction into a position designated hereinafter as the reloading position. Then, the right side of the magazine $M_3$ with the three rails 69, 70, 71 is opened by rocking about the right shaft 68. Thereafter, four cartridges P are introduced into the magazine $M_3$ and after renewed adjustment of the valve 103 these cartridges are raised by the action of the lever 88 until the cartridge $P_{31}$ bears against the switching wheel $35_R$ and the lowermost cartridge is located at the height of the strut $60_d$. The lever 40 (FIGS. 1, 2) is now moved away from the stop 41 so that it is pushed forwardly together with the sleeve 37, under the action of the spring 39, and couples with the sleeve 36 and thus with the switching wheel $35_R$ which is disconnected from its drive mechanism.

During rotation of the lever 40 and the switching wheel $35_R$ coupled therewith through 90° in the clockwise direction (viewed in the showing of FIG. 6) the cartridge $P_{31}$ is engaged by the switching wheel $35_R$ and conveyed into the waiting or ready position illustrated in FIG. 6. Thereafter, the right lever 88 is again moved back into the reloading position and a pawl which has not been particularly shown in the drawing prevents the cartridges $P_{32}$ to $P_{34}$ from falling back. After three further cartridges $P_{35}$, $P_{36}$, $P_{37}$ have been loaded into the magazine $M_3$, there is exerted an indexing or feed force upon the magazine contents $P_{31}$ to $P_{36}$ by renewed adjustment of the valve 103, associated with the cylinder $92_R$, into the position of FIG. 8. Thereafter, the lever 40 is brought out of engagement with the sleeve 36, rotated back through 90° into its starting position and placed against the stop 41.

While there are shown and described present preferred embodiments of the invention, it is to be distinctly understood that the invention is not limited thereto, but may be otherwise variously embodied and practiced within the scope of the following claims. ACCORDINGLY,

What is claimed is:

1. An automatic firing weapon comprising at least two cartridge magazines, a common discharge channel, said two cartridge magazines containing loose cartridges for conveyance into the common discharge channel, means for switching the delivery of cartridges from one cartridge magazine to the other cartridge magazine, said switching means comprising mechanism selectively adjustable into two positions independent of the emptying of one of the cartridge magazines, said mechanism in one position feeding the cartridges out of one cartridge magazine into the discharge channel and at the same time blocking the cartridges in the other cartridge magazine, a switching wheel located in the discharge channel, a hydraulic-mechanical feed device for delivering the loose cartridges from the cartridge magazine opened by said adjustable mechanism to said switching wheel, said switching wheel bringing the cartridges into a central position substantially coaxial with the lengthwise axis of the weapon.

2. The automatic firing weapon as defined in claim 1, wherein two respective cartridge magazines are located to each side of the lengthwise axis of the weapon, a respective one of said adjustable mechanisms arranged to each side of the lengthwise axis of the weapon, means for operating said actuatable mechanisms independently of one another, and a respective one of said switching wheels provided to each side of the lengthwise axis of the weapon.

3. An automatic firing weapon comprising at least two cartridge magazines, a common discharge channel, said two cartridge magazines containing loose cartridges for conveyance into the common discharge channel, means for switching the delivery of cartridges from one cartridge magazine to the other cartridge magazine, said switching means comprising mechanism selectively adjustable into two positions independent of the emptying of one of the cartridge magazines, said mechanism in one position feeding the cartridges out of one cartridge magazine into the discharge channel and at the same time blocking the cartridges in the other cartridge magazine, the adjustable mechanism comprises a slide member selectively displaceable into two positions, two spring-loaded guide portions hingedly connected with said slide member, said slide member when in one of its positions deflecting the cartridges by means of one guide portion out of the one cartridge magazine into the discharge channel and the cartridges in the other cartridge magazine being blocked by the other guide portion.

4. The automatic firing weapon as defined in claim 3, including hydraulic cylinder means for actuating the slide member and for hydraulically locking said slide member in each of said two positions.

5. The automatic firing weapon as defined in claim 1, wherein one said hydraulic-mechanical feed device is provided for each cartridge magazine, each said hydraulic-mechanical feed device comprising a plate member guided within its associated cartridge magazine, said plate member engaging at the cartridges, hydraulic cylinder means operatively associated with each cartridge magazine, a lever system for connecting the plate member with said hydraulic cylinder means of the associated cartridge magazine.

6. The automatic firing weapon as defined in claim 5, wherein the plate member viewed in the lengthwise direction of the cartridges, is arranged at a location in the cartridge magazine where there is located the center of gravity of the cartridges.

* * * * *